US007267183B2

(12) United States Patent
Denton et al.

(10) Patent No.: US 7,267,183 B2
(45) Date of Patent: Sep. 11, 2007

(54) DRILL BIT LUBRICANT WITH ENHANCED LOAD CARRYING/ANTI WEAR PROPERTIES

(75) Inventors: Robert Denton, Pearland, TX (US); Alan W. Lockstedt, Houston, TX (US); Alysia C. White, Fulshear, TX (US)

(73) Assignee: Smith International, Inc., Houston, TX (US)

( * ) Notice: Subject to any disclaimer, the term of this patent is extended or adjusted under 35 U.S.C. 154(b) by 213 days.

(21) Appl. No.: 11/130,015

(22) Filed: May 16, 2005

(65) Prior Publication Data

US 2006/0254823 A1 Nov. 16, 2006

(51) Int. Cl.
*E21B 10/24* (2006.01)

(52) U.S. Cl. ..... 175/57; 175/227; 507/905; 508/537

(58) Field of Classification Search ..... 175/57, 175/227, 228, 229, 337; 507/905, 140, 145, 507/103; 508/537
See application file for complete search history.

(56) References Cited

U.S. PATENT DOCUMENTS 3,062,741 A 11/1962 Crowl
3,107,878 A 10/1963 Wong
3,281,355 A 10/1966 Cyphers et al.
3,384,582 A 5/1968 Groszck
3,471,403 A 10/1969 LeSuer et al.
4,358,384 A 11/1982 Newcomb
4,555,352 A 11/1985 Garner et al.
4,827,064 A 5/1989 Wu
5,322,631 A 6/1994 Fuchigami et al.
5,385,683 A 1/1995 Ransom
5,492,638 A 2/1996 Wallace et al.
5,576,273 A 11/1996 Karol et al.
5,589,443 A 12/1996 Denton et al.
5,668,092 A 9/1997 Denton
5,750,477 A 5/1998 Sumiejski et al.
5,861,523 A 1/1999 Reyniers et al.
6,294,507 B1 9/2001 Dahl
6,429,175 B1 8/2002 Stuart, Jr. et al.
2003/0036485 A1 2/2003 Sanborn
2003/0069145 A1 4/2003 Chambard et al.
2003/0144158 A1 7/2003 Petelot
2004/0092408 A1 5/2004 Willey et al.
2004/0220059 A1 11/2004 Esche

*Primary Examiner*—William Neuder
*Assistant Examiner*—Nicole Coy
(74) *Attorney, Agent, or Firm*—Osha Liang LLP

(57) ABSTRACT

A high-temperature lubricant is shown and described. The lubricant includes a base stock and about 1 to about 20 weight percent zirconium 2-ethylhexanoate. The lubricant may also include about 1 to about 9 weight percent bismuth 2-ethylhexanoate.

14 Claims, 1 Drawing Sheet

DRILL BIT LUBRICANT WITH ENHANCED LOAD CARRYING/ANTI WEAR PROPERTIES

BACKGROUND OF INVENTION

1. Field of the Invention

The invention relates generally to a lubricant for lubricating journal bearings in a rock bit for drilling earth formations.

2. Background Art

Rock bits are employed for drilling wells in subterranean formations. Such bits have a body connected to a drill string and a single roller cone or a plurality (typically three) of roller cones mounted on the body for drilling rock formations. The roller cones are mounted on journals or pins integral with the bit body at its lower end. In use, the drill string and bit body are rotated in the bore hole, and each cone rotates on its respective journal as the cone contacts the bottom of the bore hole being drilled.

When such a drill bit is used in hard, tough formations, high pressures and temperatures are encountered. The total useful life of a drill bit in such severe environments is in the order of 20 to 200 hours for bits in sizes of about 6 to 28 inch diameter at depths of about 5,000 to 20,000 feet. Useful lifetimes of about 65 to 150 hours are typical. When a drill bit wears out or fails as a bore hole is being drilled, it is necessary to withdraw the drill string to replace the bit, a very expensive process. Prolonging the lives of drill bits minimizes the lost time in "round tripping" the drill string for replacing bits.

Replacement of a drill bit can be required for a number of reasons, including wearing out or breakage of the structure contacting the rock formation. One reason for replacing the rock bits includes failure or severe wear of the journal bearings on which the roller cones are mounted. The journal bearings are lubricated with grease adapted to survive in these severe conditions. Lubrication failure can sometimes be attributed to misfit of bearings or seal failure, as well as problems with the grease.

The journal bearings are subjected to very high drilling loads, high hydrostatic pressures in the hole being drilled, and high temperatures due to drilling, as well as elevated temperatures in the formation being drilled. The journal bearings are often subjected to extremely high loads as a result of the speed of the bit and the weight of the drill string. The operating temperature of the grease in the drill bit can exceed 300° F. Considerable work has been conducted over the years to produce bearing structures and employ materials that minimize wear and failure of such bearings.

A variety of grease compositions have been previously employed. Such grease compositions comprise a generally low viscosity, refined petroleum or hydrocarbon oil basestock which provides the base lubricity of the composition and may constitute about three quarters of the total grease composition. Such basestock oil is thickened with a conventional metal soap or metal complex soap wherein the metal is aluminum, barium, calcium, lithium, sodium, or strontium. U.S. Pat. No. 4,358,384 discloses such a grease composition comprising a petroleum derived mineral oil lubricant basestock and a metal soap or metal complex soap including aluminum, barium, calcium, lithium, sodium or strontium metals. A lighter, lower-viscosity basestock is generally employed to obtain low temperature greases, and a heavier, higher-viscosity basestock is used to obtain high temperature greases.

In order to enhance the film lubricating capacity of such petroleum basestock greases, solid additives such as molybdenum disulfide, copper, lead or graphite have been previously added. Synthetic polymer extreme pressure (EP) agents and high viscosity synthetic polymers may also be used. Such materials serve to enhance the ability of the lubricant basestock to form a friction-reducing film between the moving metal surfaces under conditions of extreme pressure and to increase the load carrying capacity of the lubricants. The function of the lubricant is to minimize wear and to prevent scuffing and welding between contacting surfaces. U.S. Pat. Nos. 4,358,384, 3,062,741, 3,107,878, 3,281,355, and 3,384,582 disclose the use of molybdenum disulfide, and other solid additives such as copper, lead and graphite, which have been employed to attempt to enhance the lubrication properties of oils and greases.

However, the use of solid EP agents, which improve the load carrying capacity, has been shown to contribute to excessive seal and hub wear and drill bit seal failure. For example, drill bit lubricant compounds comprising a copper EP agent have displayed seal failure due to copper deposits and loading near the seal area. The copper accumulates near the seal area until the seal is abraded by the constant and progressive erosive contact with the copper deposit. The abraded seal eventually loses its capacity to retain the grease composition in the journal area, permitting metal to metal contact between the roller cone and the journal, causing drill bit failure. Conversely, lubricants that reduce seal and hub wear typically lack sufficient film strength, that is, load carrying capacity, to be used as a drill bit lubricant.

Additionally, the use of solid EP agents comprising heavy metal complexes are not desirable due to their general toxicity and environmental impact Accordingly, there exists a need for a lubricant that exhibits both a good load carrying capacity and reduced seal and hub wear.

SUMMARY OF INVENTION

In one aspect, the present invention relates to a lubricant that includes a base stock and about 1 weight percent to about 20 weight percent zirconium 2-ethylhexanoate.

In another aspect, the present invention relates to a roller cone drill bit that includes a bit body, a plurality of legs extending downward from the bit body, wherein each leg has a journal and each journal has a bearing surface, a roller cone mounted on each journal, wherein each roller cone has a bearing surface, a grease reservoir in communication with the bearing surfaces, and a lubricating composition in the grease reservoir and adjacent the bearing surfaces, wherein the lubricating composition includes a base stock and 10.5 weight percent zirconium 2-ethylhexanoate.

In yet another aspect, the present invention relates to a method for lubricating a roller cone drill bit, the roller cone drill bit including a bit body and a plurality of roller cones mounted on the bit body with rotatable journal bearings, the method for lubricating including the steps of contacting the journal bearings with a lubricant, where the lubricant includes a base stock and 5 weight percent zirconium 2-ethylhexanoate.

In an other aspect, the present invention relates to a method for drilling through an earth formation that includes the steps of providing a roller cone drill bit having a bit body and a plurality of roller cones mount on the bit body with rotatable journal bearings, introducing a lubricating composition to the journal bearings, where the lubricating composition includes a base stock and about 1 weight percent to about 20 weight percent zirconium 2-ethylhexonoate, securing the drill bit to the end of a drill stem, and rotating the drill bit into the earth formation.

Other aspects and advantages of the invention will be apparent from the following description and the appended claims.

DETAILED DESCRIPTION

Figure 1:
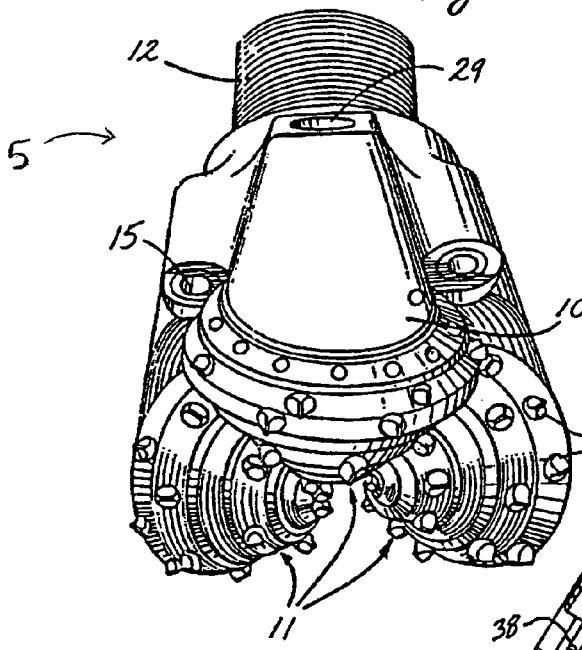
FIG. 1 is a semi-schematic perspective of a drill bit according to one embodiment of the present invention.

In one aspect, embodiments of the invention relate to lubricants for high temperature applications. As used herein, the term "high temperature" means that the lubricant will spend at least some time in an environment exceeding 250° F. In particular, embodiments of the invention relate to lubricants for drill bits, methods for lubricating, and methods for drilling. Lubricants of the invention comprise base stocks and zirconium additives. Some lubricants of the invention may further comprise bismuth additives. The zirconium additive has been found to be effective in a variety of base-oil viscosities.

In one embodiment of the present invention, a lubricant includes a base stock and about 1 weight percent to about 20 weight percent zirconium 2-ethylhexanoate. In another embodiment, the lubricant includes a base stock and 5 percent by weight zirconium 2-ethylhexanoate.

In other embodiments, the lubricant may also include about 1 weight percent to about 9 weight percent bismuth 2-ethylhexanoate. In yet other embodiments, the lubricant may also include 5 weight percent bismuth 2-ethylhexanoate. Zirconium 2-ethylhexanoate and bismuth 2-ethylhexanoate are commercially available from OM Group (OMG Americas, Inc., Cleveland, Ohio).

The base stock may be any base stock known in the art, including a synthetic base oil, a petroleum or mineral oil, or a blend of the two. Synthetic base oils may include synthetic polyalphaolefins, other hydrocarbon fluids and oils, synthetic polyethers, poly esters, alkylene oxide polymers and interpolymers, esters of phosphorous containing acids, silicon based oils and mixtures thereof. In one embodiment, the base stock may include a high viscosity index polyalpholefin base fluid. Suitable polyalphaolephins include those discussed in U.S. Pat. Nos. 5,589,443, 5,668,092, and 4,827,064. Mineral or petroleum oils may include naphthenic or paraffinic oil.

In one embodiment, the base stock may include a thickening agent. In another embodiment, the base stock does not include a thickening agent. In those embodiments where the base stock includes a thickening agent, the thickening agent may be a soap or a non-soap, or a combination thereof. In one embodiment, the base oil may be thickened with a soap, such as soaps of calcium, aluminum, titanium, barium, lithium, and their complexes. Metal complex soaps may include alkali metals, alkaline earth metals, Group IVB metals, and aluminum. Simple soaps are formed by combining a fatty acid or ester with a metal and reacting through a saponification process, with the application of heat, pressure, or agitation. While simple soaps are formed by reacting one single organic acid with a metal hydroxide, complex soaps may be formed by reacting two or more organic compounds with the metal hydroxide.

In another embodiment, the base oil may be thickened with a non-soap, such as urea, fine silica, fine clay, and silica gel. In yet another embodiment, the base stock may be thickened with both soap and non-soap thickening agents. While the above description lists several specific thickening agents, no limitation is intended on the scope of the invention by such a description. It is specifically within the scope of the present invention that other soap and non-soap thickening agents may be used.

In other embodiments, zirconium 2-ethylhexanoate, alone or in combination with bismuth 2-ethylhexanoate, may be added as an additive to a commercially available grease composition. In accordance with some embodiments of the invention, zirconium 2-ethylhexanoate may be used as an additive in a wide range of base stocks and greases, including a commercial grease such as Unirex S2® (Exxon Mobil Corp., Fairfax, Va.). In accordance with embodiments of the invention, addition of zirconium 2-ethylhexanoate may qualify the use of the grease in an application, such as use in drill bits, for which it might not otherwise be applicable.

Such grease compositions are generally comprised of two basic components: a base stock and a thickening agent. The thickening agent forms a network structure in which the base stock is held stationary. As the temperature increases, the grease will begin to soften and become liquid at the dropping point temperature. The dropping point is largely dependent upon the thickening agent used. For example, lithium soaps will result in a grease having a higher dropping point than a grease thickened with a calcium soap. The dropping point will determine the maximum usable temperature of the grease. Thus, the particular thickening agent to be used in conjunction with a base stock may be selected by one of ordinary skill in the art, depending upon the desired application and operating temperatures.

In other embodiments, the zirconium additive may be used in conjunction with other conventional lubricant additives, such as sulfur, chlorine and/or phosphorus-containing compounds, including 1,2,4-thiadiazole and molybdenum disulfide.

Referring to FIG. 1, a drill bit in accordance with an embodiment of the invention is shown. In this embodiment, as shown in FIG. 1, a drill bit 5 comprises a body 10 having three roller cones 11 mounted on its lower end. A threaded pin 12 is at the upper end of the body 10 for assembly of the drill bit 5 onto a drill string (not shown separately) for drilling oil wells or the like. A plurality of cutting elements 13 are pressed into holes in the surfaces of the roller cones 11 for bearing on the rock formation being drilled. Nozzles 15 in the bit body 10 introduce drilling mud into the space around the roller cones 11 for cooling and carrying away formation chips drilled by the drill bit 5. While reference is made to an insert-type bit, the scope of the present invention should not be limited by any particular cutting structure. Embodiments of the present invention generally apply to any rock bit (whether roller cone, disc, etc.) that requires lubrication by grease.

Figure 2:
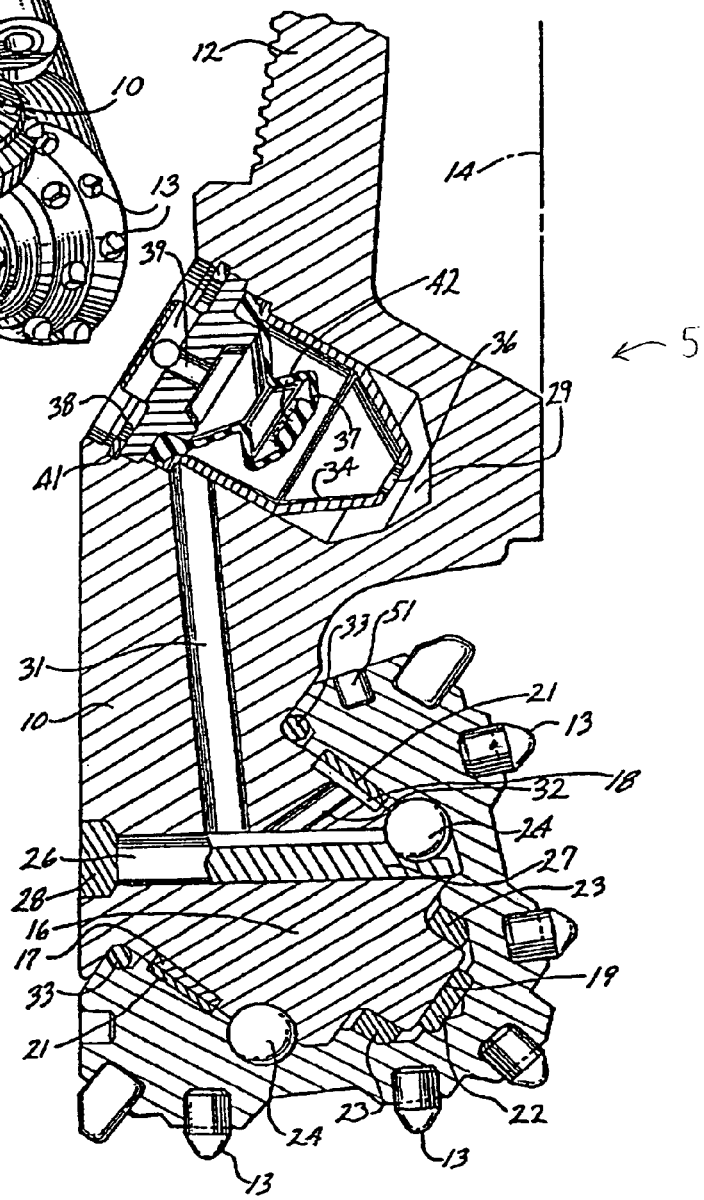
FIG. 2 is a partial cross-section of the drill bit according FIG. 1.

FIG. 2 shows a part of a longitudinal cross section of the drill bit 5 of FIG. 1, extending radially from the rotational axis 14 of the rock bit through one of the three legs on which the roller cones 11 are mounted. Each leg includes a journal 16 extending downwardly and radially inwardly on the rock bit body. The journal 16 includes a cylindrical bearing surface having a hard metal insert 17 on a lower portion of the journal 16.

Each roller cone 11 is in the form of a hollow, frustoconical steel body having cutting elements 13 pressed into holes on the external surface. For long life, the cutting elements 13 may be tungsten carbide inserts tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone 11 contains a cylindrical bearing surface including an copper nickel tin insert 21 deposited in a groove in the steel of the cone 11 or as a floating insert in a groove in the cone 11. The alloy insert 21 in the cone 11 engages the hard metal insert 17 on the leg and provides the main bearing surface for the cone on the bit body. A nose button 22 is between the end of the cavity in the cone 11 and the nose 19 and carries the principal thrust loads of the cone 11 on the journal 16. A bushing 23 surrounds the nose and provides additional bearing surface between the cone 11 and journal 16. Other types of bits, particularly for higher rotational speed applications, may have roller bearings instead of the exemplary journal bearings illustrated herein.

A plurality of bearing balls 24 are fitted into complementary ball races in the cone 11 and on the journal 16. These balls 24 are inserted through a ball passage 26, which extends through the journal 16 between the bearing races and the exterior of the drill bit 5. A cone 11 is first fitted on the journal 16, and then the bearing balls 24 are inserted through the ball passage. The balls 24 carry any thrust loads tending to remove the cone 11 from the journal 16 and thereby retain the cone 11 on the journal 16. The balls 24 are retained in the races by a ball retainer 27 inserted through the ball passage 26 after the balls are in place. A plug 28 is then welded into the end of the ball passage to keep the ball retainer in place.

The bearing surfaces between the journal 16 and cone 11 are lubricated by a lubricant or grease composition. Preferably, the interior of the drill bit is evacuated, and lubricant or grease is introduced through a fill passage (not shown separately). The lubricant or grease thus fills the regions adjacent the bearing surfaces plus various passages and a grease reservoir. The grease reservoir comprises a cavity 29 in the bit body 10, which is connected to the ball passage 26 by a lubricant passage 31. Lubricant or grease also fills the portion of the ball passage 26 adjacent the ball retainer, the open groove 18 on the upper side of the journal 16, and a diagonally extending passage 32 therebetween. Lubricant or grease is retained in the bearing structure by a resilient seal 33 between the cone 11 and journal 16.

A pressure compensation subassembly is included in the grease reservoir 29. This subassembly comprises a metal cup 34 with an opening 36 at its inner end. A flexible rubber bellows 37 extends into the cup 34 from its outer end. The bellows 37 is held in place by a cap 38 with a vent passage 39. The pressure compensation subassembly is held in the grease reservoir by a snap ring 41.

When the drill bit is filled with lubricant or grease, the bearings, the groove 18 on the journal 16, passages in the journal 16, the lubrication passage 31, and the grease reservoir on the outside of the bellows 37 are filled with lubricant or grease. If the volume of lubricant or grease expands due to heating, for example, the bellows 37 is compressed to provide additional volume in the sealed grease system, thereby preventing accumulation of excessive pressures. High pressure in the grease system can damage the seal 33 and permit abrasive drilling mud or the like to enter the bearings. Conversely, if the grease volume should contract, the bellows 37 can expand to prevent low pressures in the sealed grease systems, which could cause flow of abrasive and/or corrosive substances past the seal.

In one embodiment, the lubricant or grease in the grease reservoir may include a base stock and about 1 weight percent to about 20 weight percent zirconium 2-ethylhexanoate. In another embodiment, the lubricant or grease may include a base stock and about 5 weight percent zirconium 2-ethylhexanoate. In other embodiments, the lubricant may also include about 1 weight percent to about 9 weight percent bismuth 2-ethylhexanoate. In yet other embodiments, the lubricant may also include about 5 weight percent bismuth 2-ethylhexanoate.

According to another embodiment of the present invention, a method for lubricating a roller cone drill bit having a bit body and a plurality of roller cones mounted on the bit body with rotatable journal bearings is provided. In one embodiment, the method for lubricating the roller cone drill bit includes the step of contacting the journal bearings with a lubricant that includes a base stock and about 1 weight percent to about 20 weight percent zirconium 2-ethylhexanoate. In another embodiment, the method for lubricating the roller cone drill bit includes the step of contacting the journal bearings with a lubricant that includes a base stock and about 5 weight percent zirconium 2-ethylhexanoate. In other embodiments, the lubricant may also include about 1 weight percent to about 9 weight percent bismuth 2-ethylhexanoate. In yet other embodiments, the lubricant may also include about 5 weight percent bismuth 2-ethylhexanoate.

According to yet another embodiment of the present invention, a method for drilling is provided. In one embodiment, the method for drilling includes the steps of providing a roller cone drill bit having a bit body and a plurality of roller cones mount on the bit body with rotatable journal bearings, introducing a lubricating composition to the journal bearings, where the lubricating composition includes a base stock and about 1 weight percent to about 20 weight percent zirconium 2-ethylhexonoate, securing the drill bit to the end of a drill stem, and rotating the drill bit into the earth formation. In another embodiment, the lubricating composition includes a base stock and about 5 weight percent zirconium 2-ethylhexanoate. In other embodiments, the lubricating composition also includes about 1 weight percent to about 9 weight percent bismuth 2-ethylhexanoate. In yet other embodiments, the lubricating composition also includes about 5 weight percent bismuth 2-ethylhexanoate.

Lubricants in accordance with embodiments of the invention have been found to have superior properties, as compared to prior art lubricants and as evidenced by the following examples.

EXAMPLES

Zirconium-Containing Lubricant

A lubricant in accordance with one embodiment of the invention was prepared employing a blend of synthetic and mineral oil as the base stock with 5 weight percent zirconium 2-ethylhexanoate and 2 weight percent bismuth 2-ethylhexanoate. The synthetic base oil is a blend of LUCANT® HC-2000 (Mitsui Chemicals America, Inc., Purchase, N.Y.) and LUCANT® HC-600 (Mitsui Chemicals America, Inc., Purchase, N.Y.). The lubricant includes approximately 10 weight percent LUCANT® HC-2000 and approximately 31 weight percent LUCANT® HC-600. The thickened mineral oil comprised approximately 43 weight percent of the lubricant. Six weight percent (6%) of molybdenum-disulfide was also added to the lubricant. The zirconium-containing lubricant was subjected to a Four Ball EP test to determine the load carrying capacity of the lubricant, under ASTM 2596, the results of which are shown in Table 1. Table 1 also shows the viscosity, the temperature limit, elastomer compatibility, and environmental toxicity of this lubricant, as compared with those of the prior art lubricants.

Comparative Lubricants

Prior art lubricant compositions used in comparison include STL-058, and MS-8. These lubricants are proprietary to Smith International, Inc. MS-8 is a grease that includes a lithium complex soap and bismuth, copper, and boron nitride. The base oil is a blend of synthetics and mineral oils. STL-058 is ultra-high viscosity synthetic grease, which includes silica as a thickening agent and sulfur-phosphorus as an EP additive. The Four Ball Test results, viscosities, temperature limits, elastomer compatibility, and environmental toxicity of these comparative lubricant are shown in Table. 1.

TABLE 1

| Lubricant | 4-Ball Load (ASTM 2596) | Viscosity (250° F.) | Temp. Limit | Elastomer Compatible | Environ-mental |
|---|---|---|---|---|---|
| STL-058 | 1,000 kg | 1100 cP | 425° F. | HSN only | Non-toxic |
| MS-8 | 800 kg | 450 cP | 400° F. | Yes | Non-toxic |
| Zirconium | 1000 kg+ | 465 cP | 400° F. | Yes | Non-toxic |

Table 1 shows that the zirconium-containing lubricant in accordance with one embodiment of the invention has a high load carrying capacity, a high viscosity, and a high upper temperature limit. Additionally, the lubricant is elastomer compatible such that it will not break down an elastomer seal that may be used in conjunction with the lubricant's application in drill bits, for example. Furthermore, the lubricant is non-toxic.

It was also found that zirconium adds corrosion resistance to the metal surface. This corrosion resistance aids in reducing seal hub wear with improved seal appearance. In these tests, seal nibbling was not found in zirconium containing compositions. In addition, this lubricant also showed low leakage rate during dynamic seal tests.

It should be also understood that a lubricant according to embodiments of the present invention may also comprise a variety of additives other than those specifically described. For example, the composition may also comprise other types of extreme pressure additives, corrosion inhibitors, oxidation inhibitors, anti-wear inhibitors, or thickening agents, as known in the art. For example, the composition may include additional lubricant additives such as graphite to enhance lubrication characteristics. Additionally, the composition may include additives such as water repellents, anti-foam agents, color stabilizers, and odor-control agents.

Although embodiments including a roller cone bit have been described herein, many modifications and variations will be apparent to those skilled in the art. There are a variety of bit configurations known in which lubricant compositions may be used. Accordingly, it is to be understood that some embodiments of lubricants of the present invention may be used with bits other than that specifically described herein and in applications other than drilling. Additionally, the use of the lubricant is not limited to drill bits. The lubricant can also be suitable for use in other applications, such as bearing lubrication, and other high temperature and/or high speed lubrication applications.

Advantages of the embodiments of the invention may include one or more of the following. Both the zirconium additive and bismuth additive are non-toxic and thus may allow for easier handling with respect to manufacture, storage, use, and final deposit of the lubricant. The zirconium additive may also add corrosion resistance to a metal surface to which the lubricant may be applied. This corrosion resistance may aid in reducing the hub wear and improve the seal appearance with low leakage rates. Seal nibbling may also be reduced when a zirconium additive-containing lubricant or grease is used.

The zirconium additive may also be effective in a variety of base stock viscosities and thus effectiveness in a range of operating temperatures. The range of applicability for the zirconium additive may also allow it to be used with a variety of existing commercially available greases to improve lubrication properties and broaden the applicable uses of the greases to otherwise non-applicable uses, such as drilling.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A roller cone drill bit, comprising:

a bit body;

at least one leg extending downward from the bit body, wherein each leg has a journal and each journal has a bearing surface;

a roller cone mounted on each journal, wherein each roller cone has a bearing surface;

a grease reservoir in communication with the bearing surfaces; and a lubricating composition in the grease reservoir and adjacent the bearing surfaces, the lubricating composition comprising:

a base stock; and about 1 to about 20 weight percent zirconium 2-ethylhexanoate, wherein the lubricating composition is substantially free of lead.

2. The roller cone drill bit of claim 1, wherein the base stock comprises at least one oil selected from the group consisting of a synthetic base oil, a mineral oil, or a blend thereof.

3. The roller cone drill bit of claim 1, wherein the base stock comprises a thickening agent.

4. The roller cone drill bit of claim 1, further comprising:

an additive comprising at least one element selected from the group consisting of sulfur, chlorine, and phosphorous.

5. The roller cone bit of claim 1, comprising about 5 weight percent zirconium 2-ethylhexanoate.

6. The roller cone bit of claim 1, further comprising:

about 1 to about 9 weight percent bismuth 2-ethylhexanoate.

7. The roller cone bit of claim 1, further comprising:

about 5 weight percent bismuth 2-ethylhexanoate.

8. The roller cone bit of claim 1, further comprising:

at least one additive selected from the group consisting of extreme pressure additives, corrosion inhibitors, oxidation inhibitors, anti-wear inhibitors, and thickening agents.

9. The roller cone bit of claim 1, wherein the base stock comprises a high viscosity index polyalpholefin base fluid.

10. A method for drilling through an earth formation, comprising:

providing a roller cone drill bit having a bit body, a grease reservoir, and at least one roller cone mounted on the bit body with at least one rotatable journal bearing, wherein the grease reservoir contains a lubricant, wherein the lubricating composition comprises:

a base stock; and about 1 to about 20 weight percent zirconium 2-ethylhexonoate, wherein the lubricating composition is substantially free of lead;

securing the drill bit to the end of a drill string; and rotating the drill bit under an applied load on the earth formation.

11. The method of claim 10, further comprising:

introducing the lubricating composition to the journal bearings.

12. The method of claim 10, wherein the base stock comprises at least one oil selected from the group consisting of a synthetic base oil, a mineral oil, or a blend thereof.

13. The method of claim 10, wherein the base stock comprises a thickening agent.

14. The method of claim 10, wherein the lubricating composition further comprises an additive comprising at least one element selected from the group consisting of sulfur, chlorine, and phosphorous.

* * * * *